US006655894B2

(12) United States Patent
Boivin

(10) Patent No.: US 6,655,894 B2
(45) Date of Patent: Dec. 2, 2003

(54) REFUSE COLLECTION VEHICLE WITH DUAL STORAGE CHUTE SYSTEM

(76) Inventor: Claude Boivin, 7255 du Mousquet, Quebec City, Quebec (CA), G2K 1Z7

( * ) Notice: Subject to any disclaimer, the term of this patent is extended or adjusted under 35 U.S.C. 154(b) by 54 days.

(21) Appl. No.: 10/085,094

(22) Filed: Mar. 1, 2002

(65) Prior Publication Data

US 2003/0165374 A1 Sep. 4, 2003

(51) Int. Cl.[7] ..... B65F 3/04
(52) U.S. Cl. ..... 414/408; 414/406
(58) Field of Search ..... 414/406, 407, 414/408

(56) References Cited

U.S. PATENT DOCUMENTS 5,288,196 A * 2/1994 Horning et al. ..... 414/407
5,584,642 A * 12/1996 Huntoon ..... 414/408
5,599,071 A * 2/1997 Kann et al. ..... 414/408
5,846,044 A * 12/1998 Smith et al. ..... 414/406
5,938,394 A * 8/1999 Christenson ..... 414/408
6,325,587 B1 * 12/2001 Wysocki et al. ..... 414/408
6,357,988 B1 * 3/2002 Bayne ..... 414/408
6,390,758 B1 * 5/2002 McNeilus et al. ..... 414/408

* cited by examiner

*Primary Examiner*—Thomas J. Brahan
(74) *Attorney, Agent, or Firm*—David J. French

(57) ABSTRACT

A refuse collection vehicle is provided with a dual chute system for receiving sorted refuse from curbside containers that have one or two compartments. A powered lifting system elevates the curbside container, dumping sorted refuse into the dual chute system. A divided diverter plate with two panel portions present within the vehicle chute allows an operator to direct refuse into selected, segregated storage compartments within the refuse vehicle. In this manner, presorted refuse from the curbside container may be collected without any intermingling of such presorted refuse. The diverter plate has one driven portion and one free swinging portion. These portions may be joined by a temporary link to allow the free swinging panel portion to be positioned by the driven panel portion.

4 Claims, 7 Drawing Sheets

REFUSE COLLECTION VEHICLE WITH DUAL STORAGE CHUTE SYSTEM

FIELD OF THE INVENTION

This invention relates to refuse collection vehicles that contain multiple storage compartments. More particularly, it relates to a chute system for directing refuse from compartmented roadside (curbside) collection containers into the respective vehicle compartments to maintain segregation of the refuse.

BACKGROUND OF THE INVENTION

It is customary today for refuse vehicles to have multiple storage compartments, allowing refuse to be collected that has been sorted into several categories. Examples of vehicles with the capacity to collect sorted refuse, and maintain such refuse in distinct compartments without intermingling, include the following U.S. Pat. No. 5,163,805; 5,938,394 and 6,325,587.

It is also known to provide powered lifting systems for retrieving refuse containers from the roadside adjacent to a refuse collection vehicle. Examples of such a system are depicted in U.S. Pat. No. 5,163,805 and 5,398,983.

It is convenient when collecting segregated refuse that has been sorted and classified by a homeowner to be able to direct such refuse into an appropriate storage compartment on a vehicle. Accordingly one object of the invention is to provide a system for directing refuse to an appropriate storage compartment.

A particular advantage of a system with such a directing feature arises when the storage compartments on the vehicle are of differing sizes. Where two classes of refuse are being collected, the respective volumes of each class may vary from occasion to occasion. A further object of the invention is to provide a refuse direction system that will accommodate and be adjustable to such variations. This accommodation is especially suitable when refuse is being collected from compartmentalized containers placed beside the roadway that have two separate chambers containing two distinct types of refuse.

The invention in its general form will first be described, and then its implementation in terms of specific embodiments will be detailed with reference to the drawings following hereafter. These embodiments are intended to demonstrate the principle of the invention, and the manner of its implementation. The invention in its broadest and more specific forms will then be further described, and defined, in each of the individual claims which conclude this Specification.

SUMMARY OF THE INVENTION

According to the invention in one aspect, a refuse vehicle having at least two vehicle storage compartments for receiving refuse is provided with a chute or receiving system that is commonly shared by the two compartments. The chute system has outer, generally funnel-like containment walls. Between such walls a rotating director plate system is provided that can be positioned to deflect refuse into one or the other of the two compartments.

In a preferred embodiment, the director plate system is itself subdivided into two panel portions. These panel portions preferably rotate about a common axis, more preferably sharing a common axle shaft. The two panel portions are respectively positionable at deflection orientations to facilitate delivery of refuse into either of the two storage compartments. Optionally, the two panel portions may operate together, in a side-by-side position, so that they both direct refuse into a common storage compartment. Alternately, the two panel portions may be rotated with respect to each other so that they are angled apart from each other. In the latter configuration the panel portions respectively direct refuse into different storage compartments.

Thus when separate containers with different classes of refuse are present along the roadside for collection, such waste may be directed to the appropriate storage compartment on the vehicle by swinging the two panel portions together, in unison.

Particular advantages of this chute system of the invention may be achieved by utilizing a refuse container positioned adjacent to a roadway by property owners "curbside", that is itself divided into two compartments or chambers. Preferably but optionally, these chambers have separately hinged lids that open by swinging about a central common axis or about central parallel axes. Further, the refuse vehicle is provided with a lifting mechanism which elevates the roadside container to a position whereat its contents may be emptied into the chute system. This is achieved, essentially, by inverting the container at an angle of elevation that permits its two lids to open and causes the refuse contained therein to slide out into the chute system under the force of gravity.

The lifting system is positioned with respect to the chute system so that, substantially, when the roadside container is being emptied, the respective roadside container compartments are aligned to direct refuse onto the respective panel portions of the chute system. These panel portions are maintained in positions that will direct the refuse into the vehicle storage compartments in accordance with the preferences of the operator. If the panel portions are in side-by-side position, all of the refuse from the roadside a container will be directed into one compartment. But when the panel portions are angled apart from each other, the refuse from the respective container chambers is separately delivered into respective vehicle storage compartments, maintaining the segregation of the refuse.

As the panel portions may be directed to divert waste into either of the vehicle storage compartments, when used in conjunction with vehicle storage compartments of differing size capacities, the operator may allocate the refuse in accordance with the proportions of each class of refuse being collected on a given date.

In this manner, householders in a residential subdivision may presort the refuse to be placed on the roadside for collection, using the dual-compartment roadside refuse container. This segregation, at the option of the operator of the refuse vehicle, may be maintained during the loading process. By utilizing dual-compartment roadside containers that can be elevated and be presented to the chute system on the refuse collection vehicle in a single lifting action, the time for carrying out the collection process can be considerably reduced. This results in a saving which can be enjoyed both by the contractor providing the refuse collection service, and by the community which commissions such services to be carried out.

As a preferred feature of the invention one of the two panel portions of the director plate may be actuated to freely swing about an axis. The second panel portion is fitted adjacent to the first panel portion and is free to swing about the same axis. A linkage mechanism permits the operator to link the two panel portions together, and to disengage this linkage. Using this mechanism, the actuated plate may be used to "park" the freely swinging plate in a desired orientation.

The foregoing summarizes the principal features of the invention and some of its optional aspects. The invention may be further understood by the description of the preferred embodiments, in conjunction with the drawings, which now follow.

DESCRIPTION OF THE PREFERRED EMBODIMENT

Figure 1:
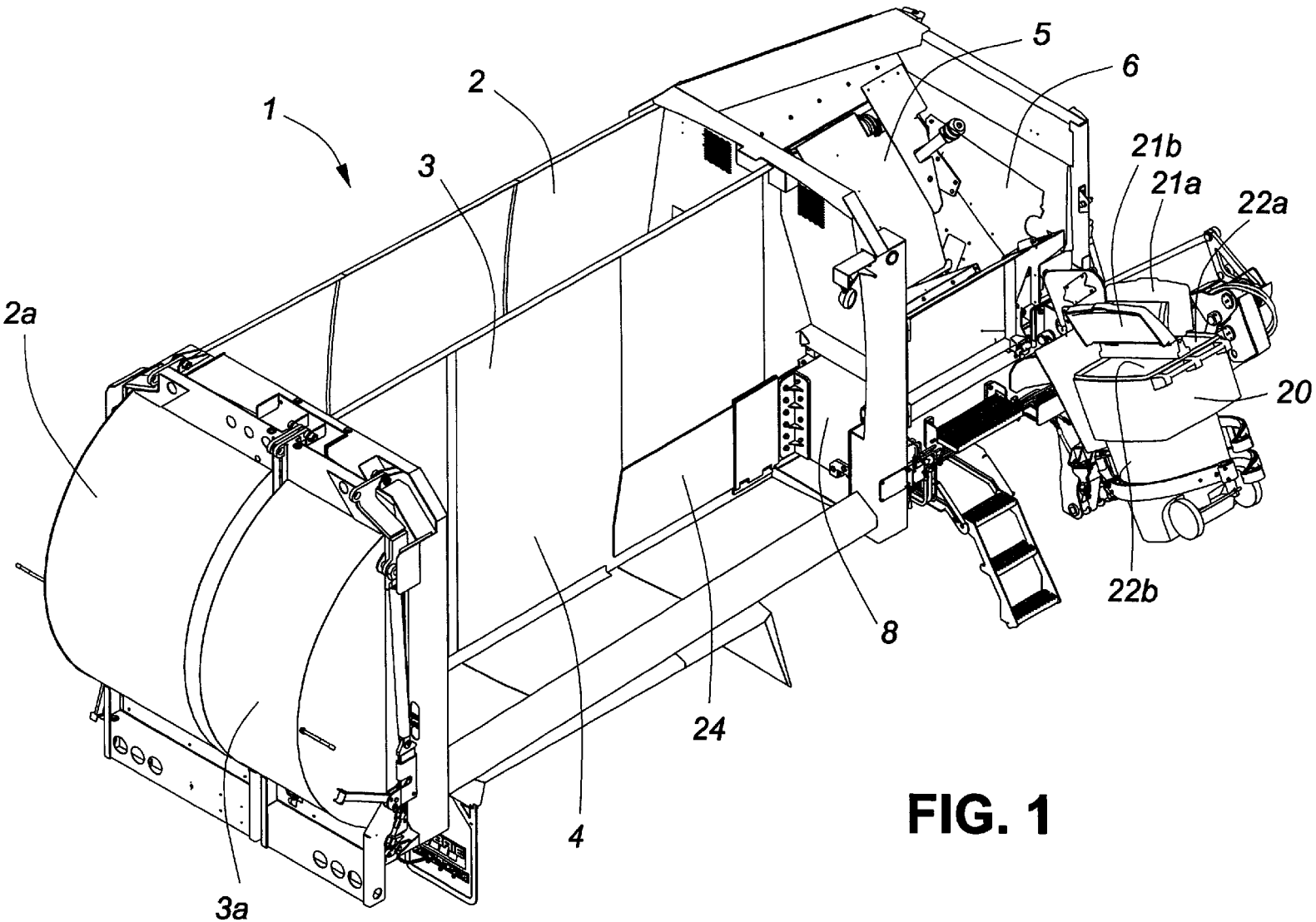
FIG. 1 is a perspective view of the bin portion of a refuse collecting vehicle having a chute system in accordance with the invention, cut-away to expose the two interior refuse storage compartments. A compactor plate beneath the chute system is fully advanced in FIG. 1 for shifting refuse into the storage bins.

In FIG. 1 the refuse collection bin 1 of a vehicle is provided with two internal compartments 2, 3 having different storage capacities. The rear doors 2*a*, 3*a* indicate their respective sizes. These compartments 2,3 are separated by a longitudinal, internal wall 4 running the length of the storage volume within the vehicle storage bin 1. At the front end of the bin 1 a loading system includes a hopper-like principal receiving volume 5 having sloping, chute-like sidewalls 6, leading to dual receiving volumes 7*a*, 7*b*—see FIGS. 2, 3. These receiving volumes 7*a*, 7*b* are traversed by a powered compaction wall 8 that separately advances refuse from the respective receiving volumes 7*a*, 7*b* into the respective compartments 2,3. An inter-compartment separation wall 24 is carried centrally by the compaction wall 8 to maintain separation of a refuse present in the receiving volumes 7*a*, 7*b*.

Figure 2:
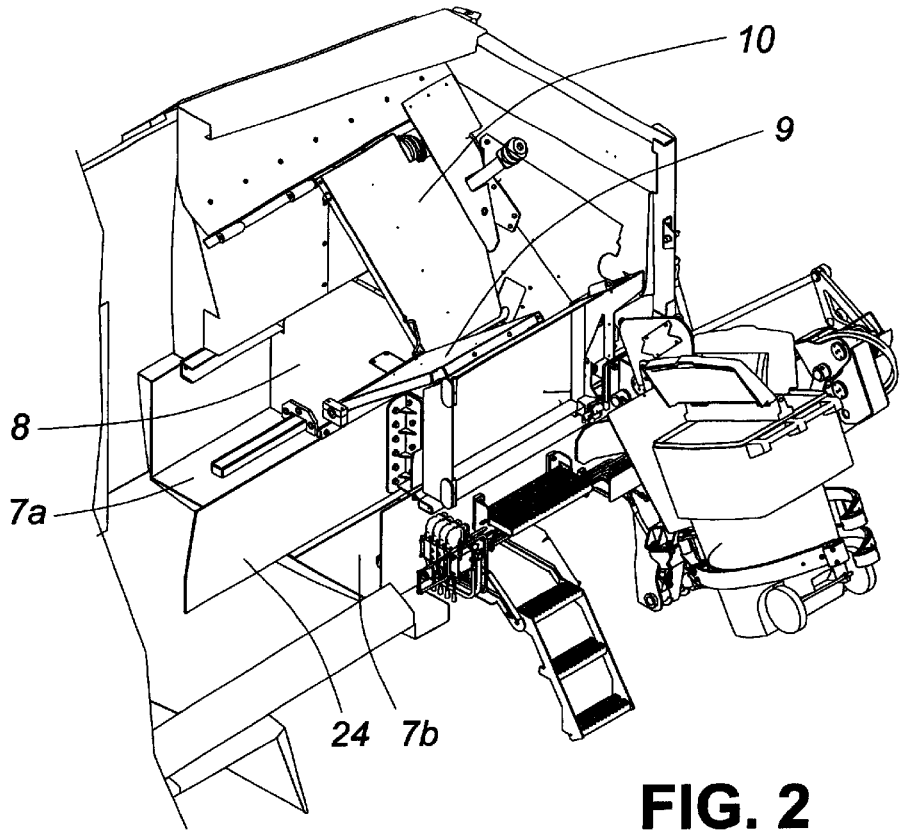
FIGS. 2 and 2*a* are further cut-away perspective view as in FIG. 1 wherein the compactor plate is progressively retracted to provide a receiving space for refuse beneath the chute system.
Figure 2A:
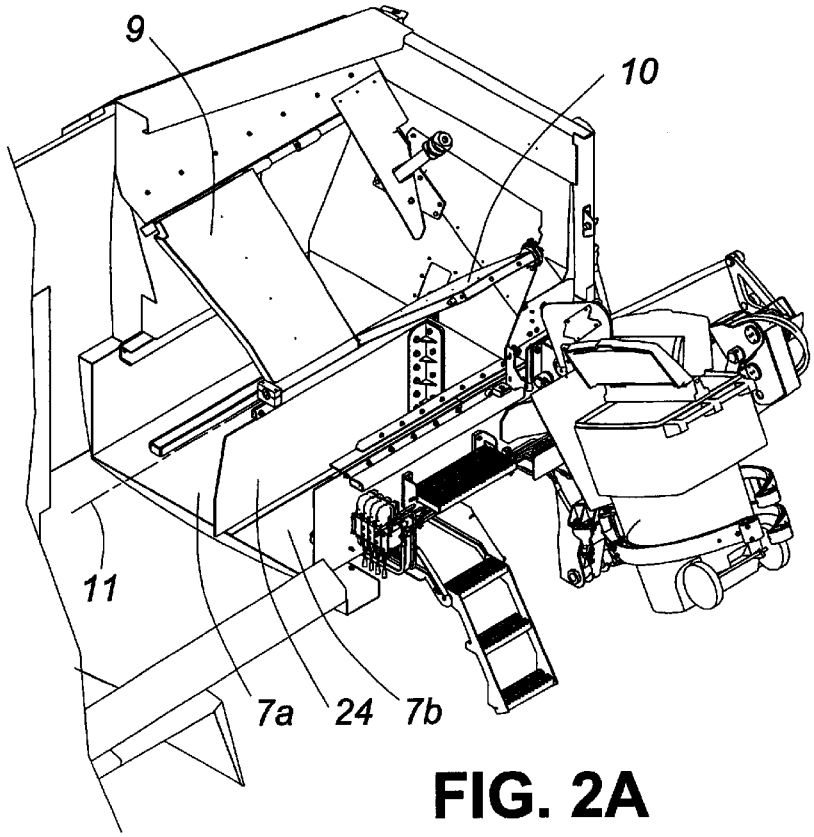
Figure 3:
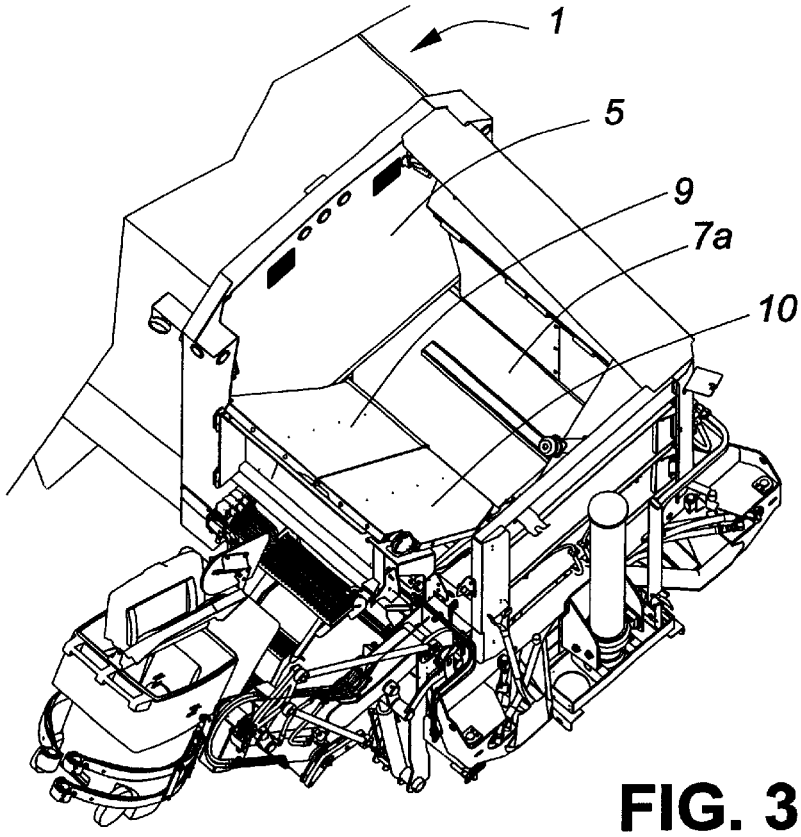
FIG. 3 is a downwardly directed perspective view of the chute system of the invention with the director system having its panel portions positioned side-by-side to receive single-compartment curbside container that is being elevated by a powered lifting arm to direct all of the contents of the roadside container into one of the two vehicle storage compartments.

In FIG. 1 the compaction wall 8 is fully advanced, having shifted refuse into the compartment 2. Accordingly, the receiving volume 7*a*, in FIG. 2, is occupied by the compaction system. In FIGS. 2 and 3 the compaction wall 8 is progressively retired, exposing respectively the receiving volumes 7*a* and 7*b*.

Figure 4:
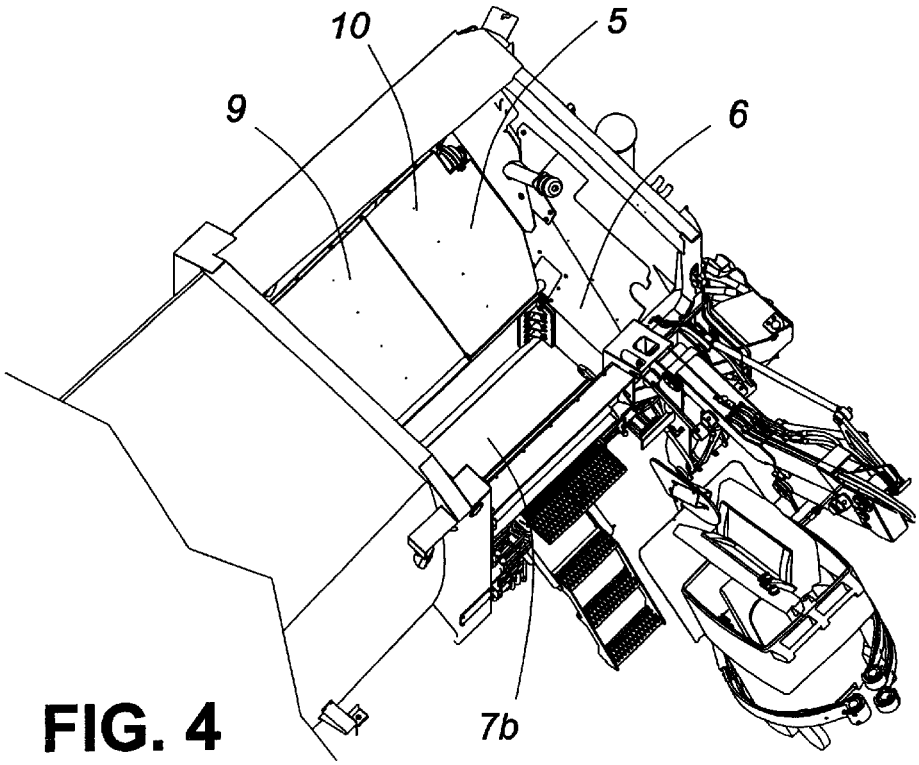
FIG. 4 is a partial view of FIG. 3 from a different perspective wherein the panel portions are again positioned side-by-side to direct refuse into the other of the two vehicle storage compartments.
Figure 5:
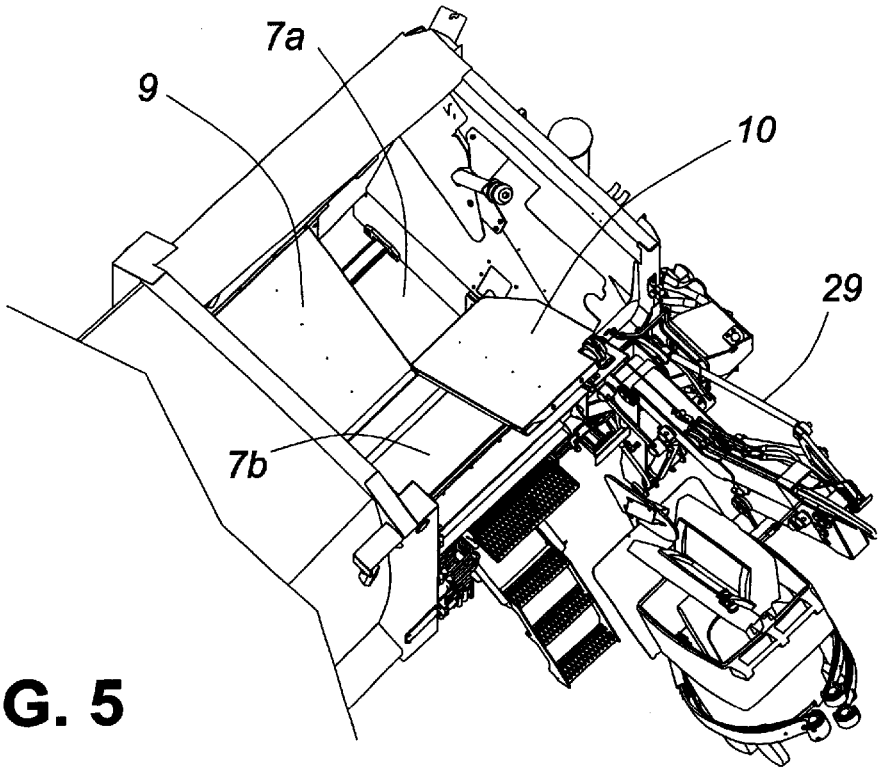
FIG. 5 is the view of FIG. 4 wherein the panel portions of the director system have been angled with respect to each other to receive refuse from the respective compartments of the roadside container, directing such refuse into respectively assigned storage compartments on the vehicle.
Figure 6:
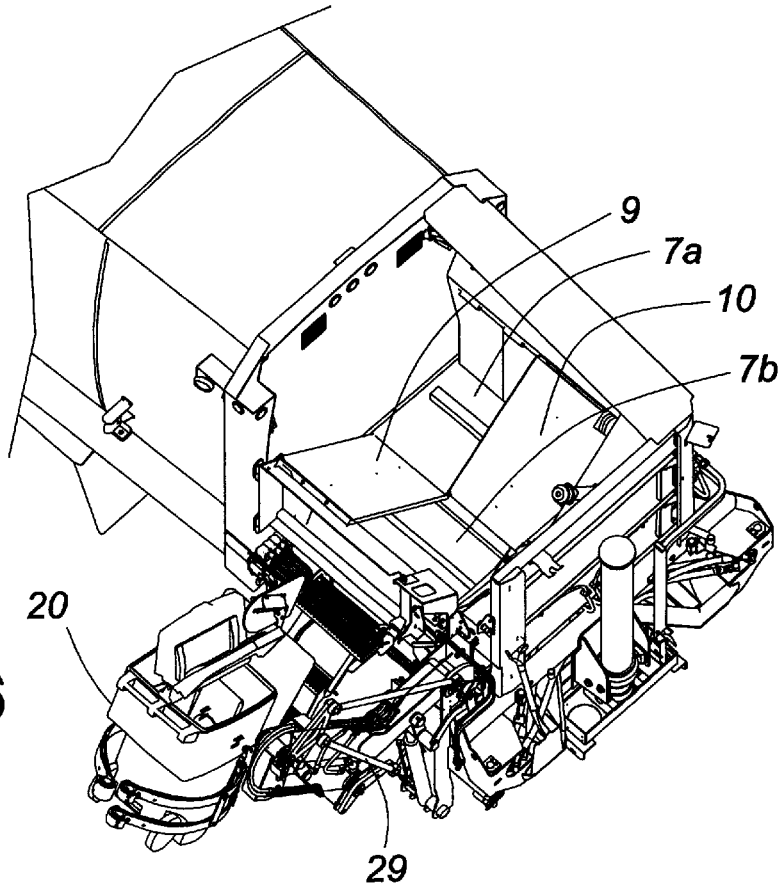
FIG. 6 is the view similar to FIG. 5 taken in from a second angle of view wherein the panel portions are reversed in their positions.

Within the receiving chute 5 is placed a rotationally orientable director plate system having to panel portions 9, 10. These panel portions 9, 10 are mounted for independent rotation about a common axis 11, enabling them to direct refuse into either of the receiving volumes 7*a*, 7*b*. These panel portions 9, 10 may swing together from one side of the receiving volume 5 to the other side of the receiving volume 5, as respectively shown in FIGS. 3 and 4. Alternately, these panel portions 9, 10 may be swung separately, diverting refuse into the respective receiving volumes 7*a*,7*b*, as shown in FIGS. 5 and 6. FIGS. 5 and 6 depict two configurations: one where panel portion 9 directs refuse to receiving volume 7*b* (FIG. 5); and one where panel portion 9 directs refuse to receiving volume 7*a* (FIG. 6). Panel portion 10 feeds the alternate receiving volume in both cases.

Figure 7:
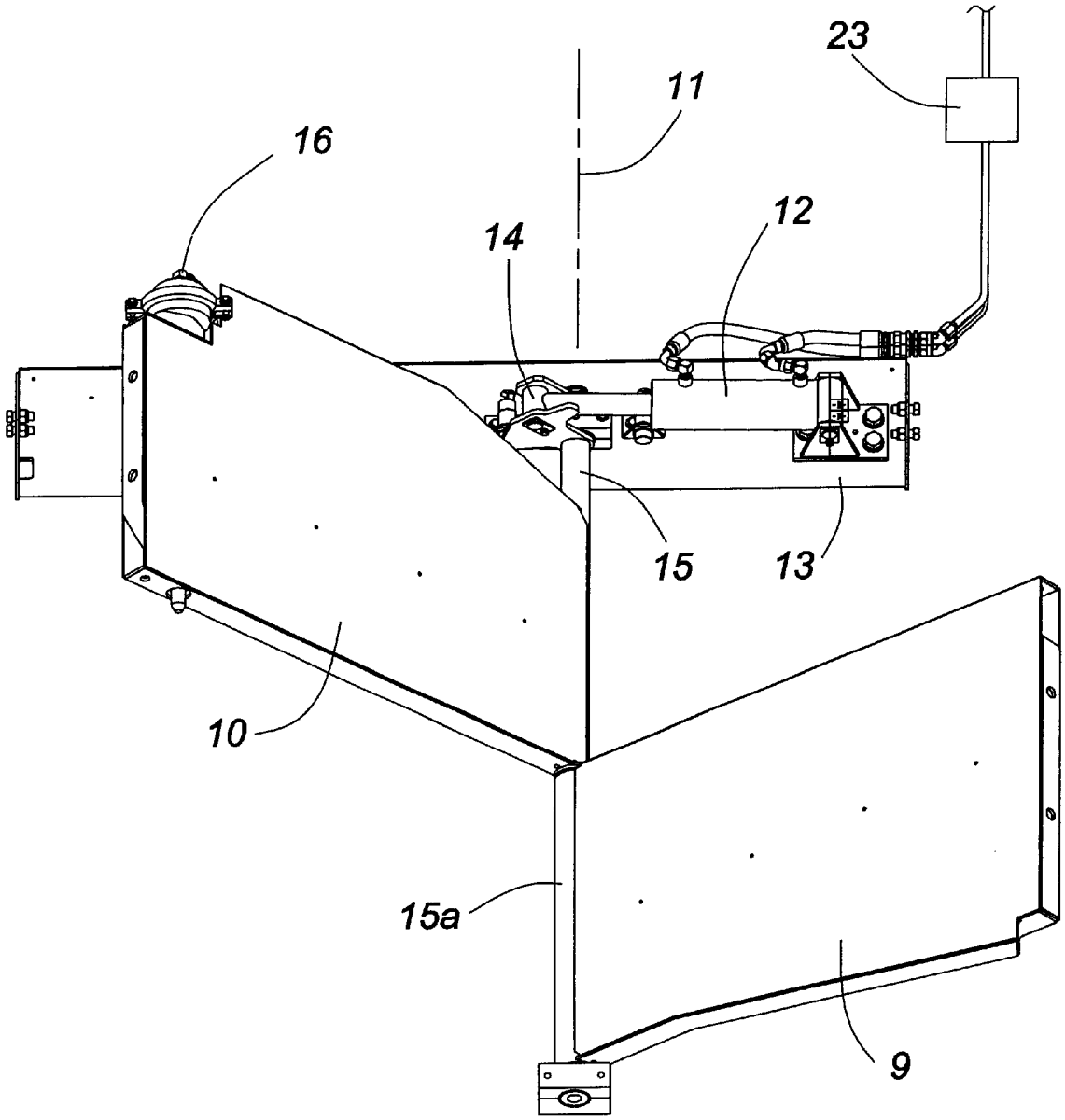
FIG. 7 is a perspective view of the two panel portions of the director system in angled positions, showing the cylindrical actuator which causes the directly actuated panel portion to rotate together about an axis.
Figure 8:
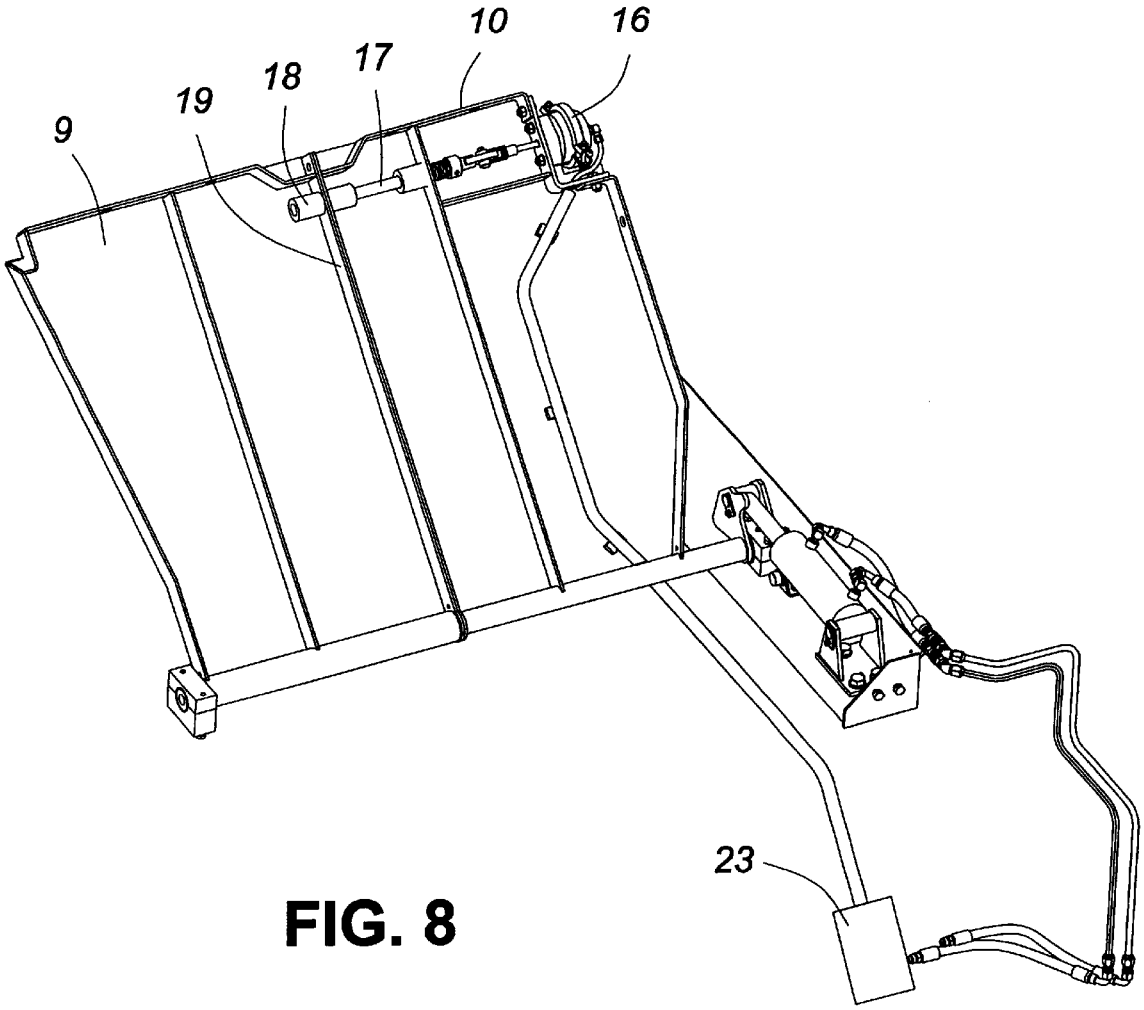
FIG. 8 is a further perspective view as in FIG. 7 wherein both panel portions have been rotated together to expose sides that have been cut-away to display the interior coupling mechanism by which the actuated panel portion may be joined to the free-swinging panel portion to cause such panels to operate in unison.

As best seen in FIGS. 7 and 8, the panel portions 9, 10 are positioned by an actuating cylinder 12 driven by compressed air, hydraulic fluid or equivalent means. The cylinder is under the remote control of an operator via control system 23. One end of the cylinder 12 is mounted to the frame 13 of the bin 1. The other end of the actuating cylinder 12 drives a cranked arm 14 which rotates a shaft 15 to which the nearest panel portion 10 is fixed. The remaining panel portion 9 is free to swing about an extension 15*a* to the shaft 15. However, this is true only for so long as the panel portions 9, 10 are not coupled together. As shown in FIG. 8, an actuated locking solenoid 16, which may be electrically, pneumatically or hydraulically driven through control system 23, is positioned on the driven panel portion 10 to advance a locking bar 17 through a collared opening 18 in the side wall 19 of the otherwise free-swinging panel portion 9. By advancement of the locking bar 17 to engage the opening 18, the two panel portions 9, 10 can be made to rotate in unison.

Moving in unison, the free-swinging panel portion 9 may be carried to one side of the receiving volume 5, as shown in FIG. 3. Then, upon disengagement of the locking bar 17, the driven panel portion 10 may be moved to do the opposite side of the receiving volume, as shown in FIG. 6. Conversely, using the locking bar 17, and the driven panel portion 10 may be used to shift the free-swinging panel portion 9 to the other side of the receiving volume, as shown in FIGS. 4 and 5.

Figure 9:
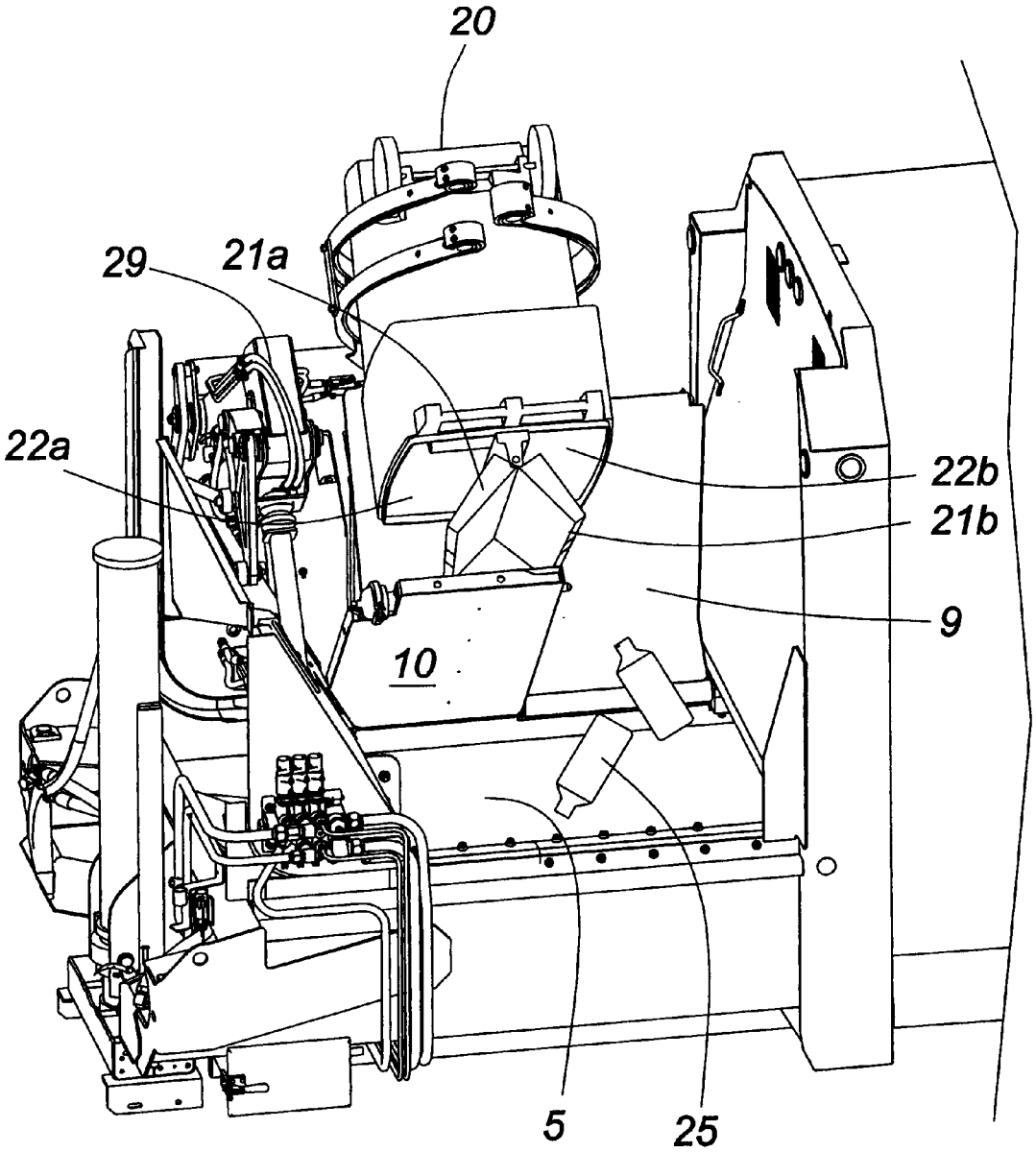
FIG. 9 is a downward-looking perspective view of a curbside refuse container inverted over the chute system so that segregated refuse is being respectively directed to differing vehicle storage compartments.

In FIG. 9 a curbside refuse container 20 is showing inverted in an elevated position by the lifting mechanism 29 with its two centrally mounted lids 21*a*, 21*b*. Open to allow refuse 25 to fall under gravity into the receiving volume 5. Because the bins are hinged to open towards each other, upon inversion of the container 20 such lids 21*a*, 21*b* form a separating barrier, directly refuse from the respective chambers 22*a*, 22*b* of the container 20 onto respective panel portions 9, 10. If the panel portions 9, 10 are in opposing orientations, then the refuse will be diverted into respective receiving volumes 7*a*,7*b*.

As these orientations may be reversed, e.g. compare FIGS. 5 and 6, the operator, by selecting the positioning of the panel portions 9, 10, through control system 23 will be able to choose the compartments 2,3 in the bin 1 to which refuse from the respective chambers 22*a*, 22*b* of the refuse containers 20 are allocated. While residents in the community may always choose to place types of refuse in assigned chambers 22*a*, 22*b* of their refuse container 20, when the operator anticipates that the volume of one type of refuse for a given day will exceed the volume of the other type, the higher volume refuse may be directed into the larger of the vehicle compartments 2,3.

In this manner, a more efficient system for collecting segregated refuse may be maintained, in concert with variations in the respective volumes of the types of refuse being collected.

CONCLUSION

The foregoing has constituted a description of specific embodiments showing how the invention may be applied and put into use. These embodiments are only exemplary. The invention in its broadest, and more specific aspects, is further described and defined in the claims which now follow.

These claims, and the language used therein, are to be understood in terms of the variants of the invention which have been described. They are not to be restricted to such variants, but are to be read as covering the full scope of the invention as is implicit within the invention and the disclosure that has been provided herein.

The embodiments of the invention in which an exclusive property or privilege is claimed are defined as follows:

1. A refuse vehicle collection system including a vehicle wherein said vehicle has at least two vehicle storage compartments and two refuse receiving volumes for receiving refuse comprising:

a) a chute system that is commonly shared by the two refuse receiving volumes, the chute system having outer containment walls and, between such walls, a rotating director plate system that can be positioned to deflect refuse into one or the other of the two receiving volumes, the director plate system being subdivided into two panel portions, b) actuation means for rotating and orienting the two panel portions whereby the two panel portions may be positioned together, in a side-by-side position, so that they both direct refuse into a common receiving volume or, alternately, may be positioned with respect to each other so that they are angled apart from each other to effect respective delivery of refuse into the two receiving volumes.

2. The collection system of claim 1 in combination with:

a) a curbside refuse container divided into two container chambers;

b) a lifting mechanism for elevating the curbside container to a position whereat its contents may be emptied into the vehicle chute system by inverting the container at an angle of elevation that causes any refuse contained therein to slide out into the chute system under the force of gravity whereby, when the curbside container is being emptied, the respective curbside container chambers are aligned to direct refuse onto the respective panel portions of the chute system so that, when the panel portions are in side-by-side position, all of the refuse from the curbside container will be directed into one receiving volume, and when the panel portions are angled apart from each other, the refuse from the respective curbside container compartments is separately delivered into the respective receiving volumes for transfer to the vehicle storage compartments, thereby maintaining the segregation of the refuse originally present in the compartments of the curbside container.

3. A refuse vehicle collection system as in claim 1 wherein the panel portions rotate about a common axis and comprising:

a) an actuator to effect rotation of a first driven panel portion, b) a disengageable link carried by one of said two panel portions for engagement with the other panel portion whereby the other panel portion may be engaged and rotated to a desired orientation by the driven panel portion.

4. A refuse collection system as in claim 3 wherein the disengageable link and actuator for effecting rotation are remotely controllable by an operator through a control system.

* * * * *